US006132812A

United States Patent [19]

Rödhammer et al.

[11] Patent Number: 6,132,812

[45] Date of Patent: Oct. 17, 2000

[54] PROCESS FOR MAKING AN ANODE FOR X-RAY TUBES

[75] Inventors: Peter Rödhammer; Dietmar Sprenger, both of Reutte, Austria

[73] Assignee: Schwarzkopf Technologies Corp., Franklin, Mass.

[21] Appl. No.: 09/059,233

[22] Filed: Apr. 13, 1998

[30] Foreign Application Priority Data

Apr. 22, 1997 [AT] Austria ..... 244/97 U

[51] Int. Cl.[7] ..... C23C 4/12

[52] U.S. Cl. ..... 427/446; 427/455; 427/456; 427/576; 427/564; 378/143; 378/144

[58] Field of Search ..... 427/446, 455, 427/456, 576, 564; 378/143, 144

[56] References Cited

U.S. PATENT DOCUMENTS

| | | | |
|---|---|---|---|
| 4,534,993 | 8/1985 | Magendans et al. | 378/144 |
| 4,573,185 | 2/1986 | Lounsberry et al. | 378/125 |
| 4,853,250 | 8/1989 | Boulos et al. | 427/446 |
| 5,157,705 | 10/1992 | Hohenauer | 378/143 |
| 5,844,192 | 12/1998 | Wright et al. | 219/76.16 |

FOREIGN PATENT DOCUMENTS

| | | | |
|---|---|---|---|
| 0 116 385 A1 | 1/1984 | European Pat. Off. | H01J 35/10 |
| 0 421 521 B1 | 9/1990 | European Pat. Off. | H01J 35/10 |
| 3521787A1 | 6/1985 | Germany | H01J 35/10 |
| 5-311462 | 11/1993 | Japan . | |

*Primary Examiner*—Katherine A. Bareford
*Attorney, Agent, or Firm*—Morgan & Finnegan, L.L.P.

[57] ABSTRACT

The invention pertains to a method for the production of an anode for X-ray tubes, and the invention also pertains to the resulting anode. In the invention, a coating that emits X-ray radiation is applied by inductive vacuum plasma spraying onto the base element. Using this method, an improved fatigue crack resistance and a reduced roughening of the coating on the anode is achieved.

13 Claims, 4 Drawing Sheets

PROCESS FOR MAKING AN ANODE FOR X-RAY TUBES

BACKGROUND OF THE INVENTION

1. Field of the Invention

The invention pertains to a method for the production of an anode for X-ray tubes, consisting of a base element and a coating that emits X-ray radiation, the coating differing from the base element.

2. Description of Related Art

To produce X-ray radiation, materials that emit X-rays when impacted by a focused electron beam are used. The high-melting-point metals tungsten and molybdenum and their alloys, for example, are materials typically employed, depending on the desired type of X-ray radiation.

In medical diagnostics, rotary anodes are often used for X-ray tubes in the form of axial-symmetrical disks for the generation of X-ray radiation. In most cases, only one portion of the surface is designed in the form of a ring-shaped path—the so-called focal track—in the region directly impacted by the electron beam. This focal track uses a comparatively thin coating of material to generate the X-rays. The base element of the rotary anode consists of other high-melting-point materials.

The specific material properties of the coating, such as lattice, thermal conductance, thermal expansion, mechanical properties, and thickness are important factors for the practical behavior of the focal track coating during X-ray operation. A permanent residual porosity has an adverse effect on the thermal conductance, the fatigue crack resistance, and the gas evolution in the X-ray tube. This means that the greatest possible density values are desirable for the comparatively thin focal track coating. A reduced fatigue crack strength is primarily expressed by a greatly increasing roughening of the focal track with increased use, and by a reduced X-ray yield associated with the fatigue cracking.

The focal track coating has been produced to this time primarily by means of powder-metallurgical methods (e.g., pressing, sintering, and forging). In the case of metallic materials used for the base element, the coating is primarily produced in one working step of the base element by coating the base element with the powder mixtures. In this manner, density values for the coating of 96–98% of the theoretical density are attained as the standard. A production method of this type for the focal track coating is low in cost, but results in properties that are not the optimum, particularly with regard to fatigue crack behavior.

In particular, where graphite is used as the base element material, the linkage of the base element with an independent focal track coating, produced by powder metallurgy is difficult. In contrast to powder metallurgy, a focal track coating may also be applied by known deposition coating methods, preferably by chemical vapor deposition (CVD) or even by physical vapor deposition. Of course, with vapor deposition, densities of nearly 100% of the theoretical density can be attained for the focal track coating. However, due to significantly greater manufacturing costs, vapor deposition production methods have been generally limited to production of rotary anodes with graphite bodies. Vapor deposition has not been able to replace the method of powder metallurgy for manufacturing the focal track coating.

As a somewhat lower-cost coating method with a number of processing advantages, the method of conventional plasma spraying can be used. This applies in particular when the method is applied under a controlled atmosphere, i.e., under a vacuum or inert gas atmosphere. In conventional plasma spraying, the material for the focal track coating is radially introduced as a powder into a plasma beam generated by a dc arc discharge, then melted in the plasma beam and the molten droplets are deposited on the base element. Some important advantages of this method are the high application power per unit time, a coating temperature that is adjustable over a broad range, and the avoidance of chemical compounds that are difficult to neutralize. However, in the conventional plasma spray method, in spite of intensive development efforts around the world in recent years, focal track coatings with a maximum density of only 93% of the theoretical density have been attained. These densities provide unsatisfactory results for rotary anodes coated in this way with regard to fatigue cracking and gas evolution properties. The known thermal post-treatment methods that can be used, in theory, to obtain an increase in the density have only limited lid effectiveness in practice, or they have only limited applicability due to the effects on the material of the base element and/or on the composite behavior. This applies in particular to the use of graphite as a material for the base element. Under these restricting conditions, the thermal post-treatment to achieve post-compression will not be sufficient and complete gas evolution of the focal track coating will not occur. Due to these disadvantages, manufacture of rotary anodes, in which the focal track coating was applied with conventional plasma spraying is not common.

Existing methods of powder metallurgy, vapor deposition and conventional plasma spraying have failed to achieve satisfactory coatings at low cost.

SUMMARY OF THE INVENTION

It is therefor an object of the invention to provide a low-cost method for manufacture of the coating emitting the X-ray radiation for the production of anodes for X-ray tubes. It is a further object that the coating fully satisfies, or even exceeds, the standard used today with regard to its practical behavior, particularly its fatigue crack strength. This objective is achieved by applying the coating, which emits X-ray radiation, by inductive vacuum plasma spraying.

It is also an object of the invention that the fatigue crack strength of coatings applied by inductive vacuum plasma spraying is superior to coatings produced by powder metallurgy.

It is also an object of the invention for the coating emitting the X-ray radiation to be applied by repeated overcoating of individual spray layers with a total thickness between 0.4–0.6 mm. As a rule, 20–50 overcoating steps with individual layers of the spray layer are recommended.

It is also an object of the invention that before application of the coating emitting the X-ray radiation, a recess with roughly the depth of the desired coating thickness is worked into the base element in the region of this coating. In this manner, a level surface coating can be achieved by simple grinding to a plane of the adjoining anode base element.

It is also an object of the invention for the deposition to take place under an inductively linked power between 50–100 kW and at a delivery rate of the spray powder between 10–50 grams/min. Under these conditions, a total and thorough melting and sufficient overheating of the melt droplets will be obtained.

It is also an object of the invention, in comparison to parameters usually applicable to conventional plasma spraying, that the plasma particle beam passes over the surface to be coated at a comparatively low relative speed. This speed is preferably selected so that maximum temperatures of 1,400–2,400° C. will prevail in the vicinity of the point of impact of the core zone of the plasma particle beam. The base element to be coated is itself preferably heated to a temperature of 1,000–1,500° C. for this step.

It is also an object of the invention that the plasma beam and the base element are moved with respect to each other in such a manner that the central point of impact of the plasma particle beam on the anode surface, and the center line of the active focal track concentric to the axis of anode rotation, at least roughly coincide. Thus, the particle stream from the plasma beam is adjusted so that the particle stream of the plasma beam arriving within the active focal track only encompasses that region located within the half-value width of the Gaussian particle distribution of the plasma particle beam. The result is that the edge of the plasma particle beam (which is less favorable for the layer structure) is shifted mostly to regions of the anode surface located outside of the active region of the focal track. The term "active region of the focal track," means the region impacted directly by the electron beam for the generation of X-ray radiation.

It is also an object of the invention that the anode be subsequently subjected to an annealing treatment. The purpose of this annealing is both for an additional improvement of the lattice properties by means of diffusion processes, and also for gas evolution from the anode. The type of annealing treatment is dependent on the material, among other factors, used for manufacture of the base element of the rotary anode. In the case of a base element consisting of a high-melting-point metal, the annealing treatment is carried out at temperatures between 1,200–1,600° C. for a period of 1–20 hours, whereas in the case of rotary anodes in which graphite is used for the base element, as a rule it is carried out at temperatures up to 1,300° C. for a period of up to about 10 hours. In the case of a graphite base element, the possible formation of adverse carbides in the boundary region can be delayed by known diffusion barrier layers, e.g., rhenium.

It is also an object of the invention that the base element of the anode is made of graphite, molybdenum, or a molybdenum alloy and the coating emitting the X-ray radiation can consist of a tungsten-rhenium alloy.

The invented method will be explained in greater detail based on the manufacturing examples and based on the figures.

BRIEF DESCRIPTION OF THE DRAWINGS

Figure 1:
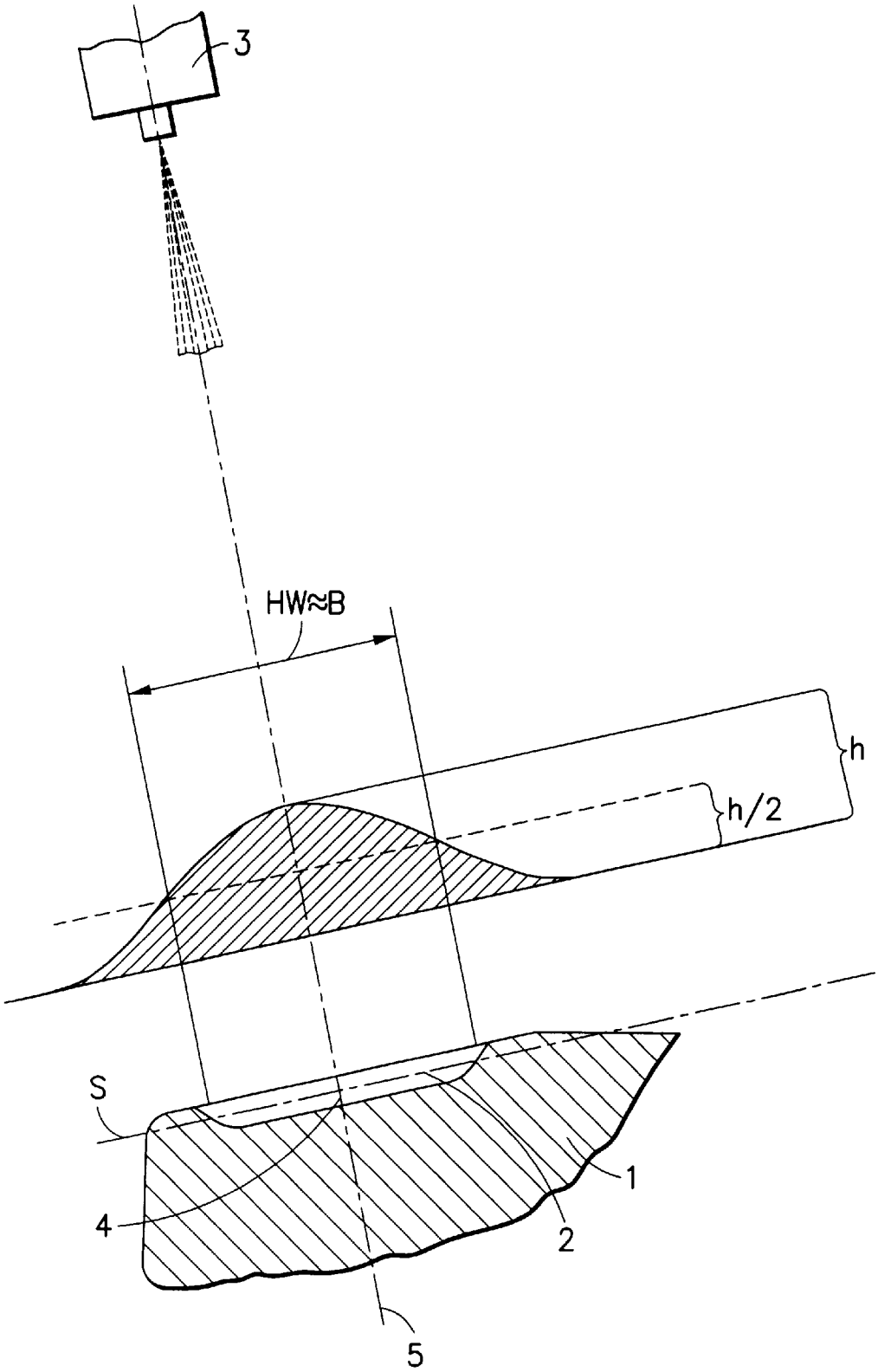
Figure 2:
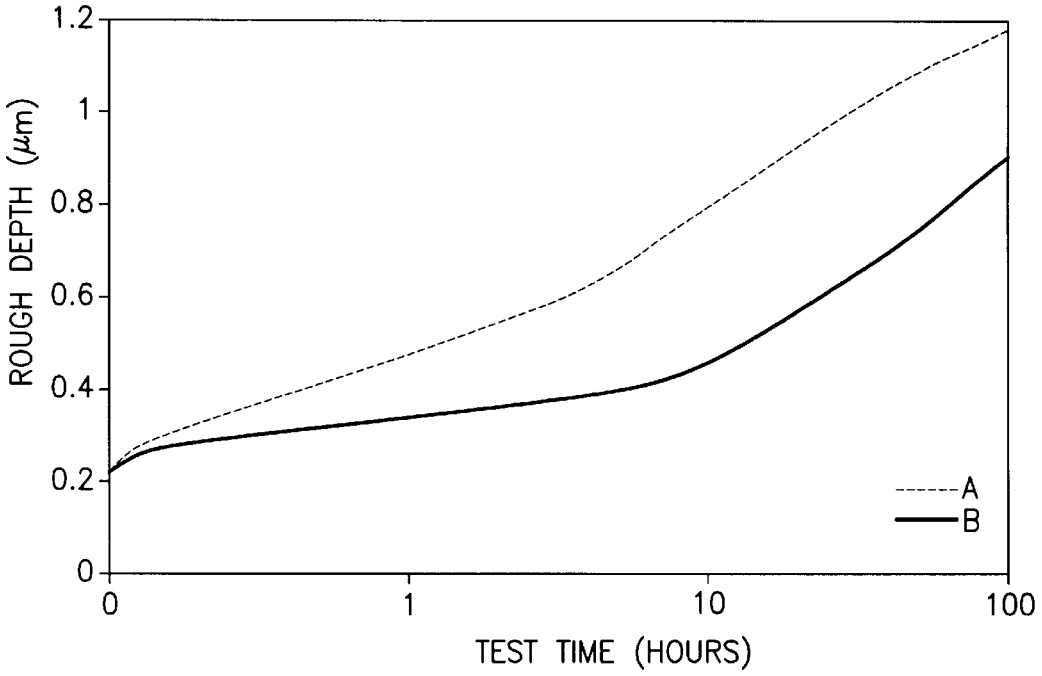

| | |
|---|---|
| FIG. 1 | A basic sketch of one variant of the method according to this invention. |
| FIG. 2 | A graphic illustration of the average values of focal track roughening (Ra, on the vertical axis) of focal track coatings as a function of time (h, on the horizontal axis) on rotary anodes produced according to this invention and by the use of powder metallurgy. One plot illustrates the present invention (B), while the other plot illustrates results of powder metallurgical methods (A). |
| FIG. 3 | Illustrates a ground micrograph of the focal track of a rotary anode with focal track coatings produced according to this invention, with a cross section shown at a 200X magnification. |
| FIG. 4 | Illustrates a ground micrograph of the focal track of a rotary anode with focal track coatings produced by powder metallurgy, with a cross section shown at a 200X magnification. |

-continued

Figure 5:
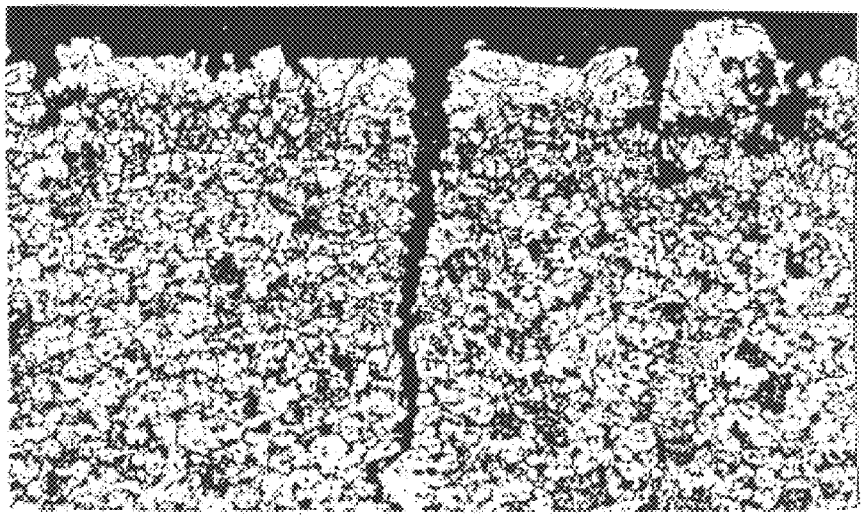

| | |
|---|---|
| FIG. 5 | Illustrates a ground micrograph of the focal track of a rotary anode with focal track coatings produced by conventional plasma spraying, with a cross section shown at a 200X magnification. |

DETAILED DESCRIPTION

In recent years, a new variant of plasma spraying, the so-called inductive vacuum plasma spraying, has been developed. The difference of this specific plasma spraying method with respect to conventional plasma spraying methods rests in the fact that the plasma is created by inductive heating, so that the spray powder can be axially applied in a simple manner just before formation of the plasma beam. Therefore, and due to the lesser expansion rate of the plasma due to the inductive heating, the powder particles remain much longer in the plasma beam. This improves the energy transmission from the plasma to the individual particles of the spray powder, so that even larger powder particles are heated entirely above their melting temperature and can be deposited as fully molten droplets. The inductive vacuum plasma spray method is thus suitable for the use with a low-cost spray powder, to accommodate a wider range of particle size, in comparison to conventional plasma spray methods.

The superior results achieved with inductive vacuum plasma spraying are somewhat surprising, because the density value of the coatings applied by inductive vacuum plasma spraying can equal the density values of coatings produced by powder metallurgy, but as a rule are below the values for powder metallurgy. Though the density values of the coating applied by inductive vacuum plasma spraying are less than the theoretical density, the reasons for improvement in fatigue crack strength cannot be unambiguously explained. One possible explanation for superior fatigue crack strength, with reduced coating density, might be the crystalline lattice produced. It appears that with inductive vacuum plasma spraying, special crystalline lattices are produced that clearly differ from the lamellar solidification lattices that are usually obtained by conventional plasma spray methods.

Two examples for producing a focal track coating according to this invention are provided.

MANUFACTURING EXAMPLE 1

Disk-shaped base elements for rotary anodes made of TZM, a molybdenum alloy with 0.5% titanium, 0.08% zirconium, up to 0.04% carbon, and the remainder molybdenum, with a diameter of 120 mm and a blunt conical outer region with a 20° opening angle, are mounted to a shaft provided with a rotation drive and installed in a vacuum chamber. Coating of the individual base elements is accomplished by means of a plasma gun with a 50-mm inside diameter with inductive heating, and a power output of 65 kW with spray powder from a tungsten alloy with 5% rhenium in a powder fraction between 15–63 $\mu$m. The spray powder is axially introduced at a delivery rate of 30 grams/min by means of Ar carrier gas. Before beginning the powder injection, the base element is heated to 1500° C. The rotation rate of the base element is 10 rpm. The inductive vacuum plasma spray gun is moved to the side of the middle line of the focal track coating running concentric to the rotary anode axis, specifically in such a manner that the axis of the plasma gun continuously moves at a rate of 2 mm/sec alternately on both sides of this middle line up to a maximum distance of 5 mm on each side. In a coating process lasting about 4 min, by means of about 50 sequentially deposited single layers, a focal track coating of about 1 mm total thickness and 25 mm width is thus applied. After completion of the coating process, the rotary anodes are cooled to below 100° C., removed from the vacuum chamber and subsequently the focal track coating is ground to a thickness of 0.7 mm. The rotary anodes, now processed to this level, are then subjected to a high-vacuum annealing at a temperature of 1600° C. for a period of 90 min.

For comparison purposes, disk-shaped base elements like those used for the previously described method were produced by powder metallurgy with an 0.8-mm-thick focal track coating made of a tungsten-5-rhenium alloy. In this case, a layering of the TZM-powder mixture for the base element on the one hand, and for the tungsten-rhenium alloy for the focal track coating on the other hand, was produced and pressed; the pressed blank was sintered and, by forging and mechanical processing, the final shape was produced. Next, the rotary anodes were subjected to the same high-vacuum annealing as those obtained according to this invention.

The density of the focal track coatings was determined by the buoyancy method. The focal track coatings applied according to this invention have a density of 97.2% of the theoretical density, whereas the focal track coatings produced by powder metallurgy have a density of 97.4% of the theoretical density.

MANUFACTURING EXAMPLE 2

Referring now to FIG. 1, in an additional manufacturing example in a similar rotary anode base element as in Manufacturing Example 1, a ring-shaped groove of 0.8 mm depth is incorporated into the region of the focal track. Next, the rotary anode base element is coated with essentially the equivalent coating conditions according to the invented method used in Manufacturing Example 1. The sole difference in this coating variant is that the inductive vacuum plasma spray gun is not moved to the side during the coating, but rather is held stationary, specifically such that the center axis 5 of the plasma gun 3 coincides with the center line 4 of the focal track coating 2 concentric to the rotary anode axis, and such that the plasma beam and thus the particle beam is adjusted so that the half value width of the particle distribution HW coincides with the width of the active region B of the focal track coating 2 as is illustrated in FIG. 1. For a better overview, FIG. 1 shows the particular local distribution of particles in the region of the focal track not directly on the rotary anode base element 1 but above it, and not true to scale but in a greatly exaggerated display. After application of the focal track coating 2 and annealing, the surface of the rotary anode is mechanically abraded, except for an amount S of 0.7 mm. This produces the final thickness and a clean lateral delimitation of the focal track coating to the rotary anode base element. The rotary anode produced with this coating variant has a somewhat better density of 97.8% of the theoretical density, compared to the rotary anodes produced according to Manufacturing Example 1 of this invention. Thus, Manufacturing Example 2 corresponds to a reduction in residual porosity of roughly 20%.

Rotary anodes produced according to the invention, as described in manufacturing examples 1 & 2, were installed in a test stand for X-ray rotary anodes and tested cyclically under standard conditions using the following parameters:

| | |
|---|---|
| Tube voltage | 90 kV |
| Tube current | 400 mA |
| Shot time | 2 sec |
| Pause time | 58 sec |

The test was interrupted at specified times in order to determine the focal track roughening as a measure of the fatigue crack resistance and the associated reduction in the X-ray dosage yield.

FIG. 2 illustrates the particular average values of the rough depth Ra obtained from three rotary anodes per variant.

The significantly better roughening values for rotary anodes produced according to this invention (B), is easy to see. After a 100-hour test time, the average rough depth Ra for anodes produced according to this invention, with Ra measured in the perimeter direction, was 24% less than the corresponding roughening value of comparison rotary anodes produced by powder metallurgy (A).

After conclusion of the 100 hour comparison test, a ground microsection was prepared from the rotary anode coated according to this invention, from the rotary anode produced by powder metallurgy and from the rotary anode produced by conventional plasma spraying. Photographs of these microsections using a 200X magnification are presented in FIGS. 3, 4 and 5 respectively.

Figure 3:
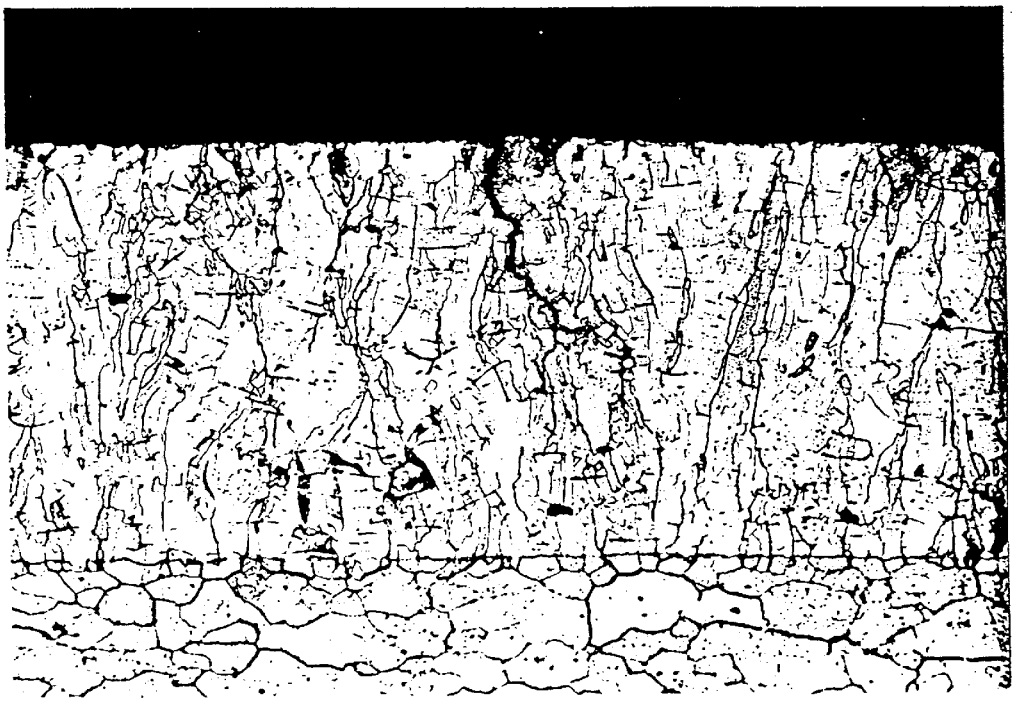
Figure 4:
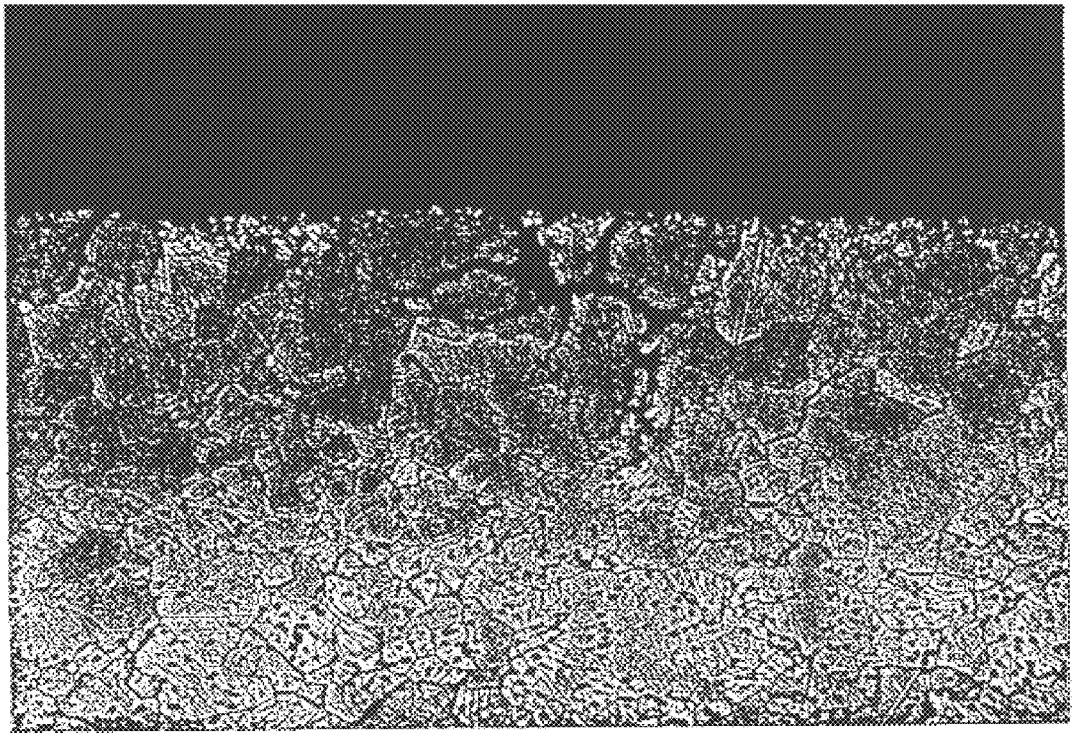

The lattice of the inductive, plasma-sprayed focal track according to FIG. 3 presents a fundamentally different morphology than the focal track in FIG. 4 produced by powder metallurgy. The impacting molten droplets when using inductive vacuum plasma spraying exhibit transcrystalline features upon solidification, that is, they are also used as crystallization surfaces for the next arriving molten droplets. Thus, once a layer starts to grow, the direction of this growth will be essentially retained, at least for numerous molten droplets, and the lamellar lattice structures usually observed in conventional plasma spraying, with their poorly bonded grain boundaries, will not form. These poor grain boundaries are clearly visible in FIG. 5 using the example of a focal track coating of a rotary anode produced by conventional plasma spraying. In the case of inductive vacuum plasma spraying, the original boundaries between sequentially solidified droplets can only be found in some cases, due to intracrystalline clusters of micropores, but they are surrounded by additional transcrystalline grains. In conclusion, the resulting, predominately column lattice with a dense structure presented in FIG. 3 is obtained. The grain boundaries between these column crystallites running in the direction of crystal growth are well defined and free of collections of micropores. In contrast to this, the grains in the powder-metallurgy lattice according to FIG. 4 are mostly isotropic. The residual porosity appears here in the form of coarse pores. The fatigue cracks of the focal track coating in a rotary anode produced according to this invention appear in the form of microcracks running essentially perpendicular to the surface. These microcracks have a less harmful effect at the moment of roughening of the surface than the cracks in rotary anodes produced by powder metallurgy. The stronger roughening and the destabilization of the surface lattice in rotary anodes produced by powder metallurgy are clearly discernible due to failures at the grain boundaries in FIG. 4.

In another comparison test, rotary anodes made according to the invention had roughening after 100 hours of use that compared to the roughening of comparison anodes after only 20 hours of use. Thus, the expected lifetime of rotary anodes made according to the invention may be five times greater than rotary anodes made according to previous methods.

The manufacturing examples describe particularly favorable variants of a manufacturing process according to this invention, but the invention is by no means limited to them. For example, it is also possible to apply the focal track coating not by means of several, sequentially layered spray coatings, but rather all at once in a single layer.

Although an illustrative embodiment of the present invention, and various modifications thereof, have been described in detail herein with reference to the accompanying drawings, it is to be understood that the invention is not limited to these precise embodiments and the described modifications, and that various changes and further modifications may be effected therein by one skilled in the art without departing from the scope or spirit of the invention as defined in the appended claims.

We claim:

1. A method for the production of an anode for X-ray tubes comprising:

preparing a base element anode by creating a ring-shaped recess in the base element, the recess having a depth approximately equal to the desired finished thickness of a coating that emits X-ray radiation and a width approximately equal to the desired finished width of the coating; and applying the coating by inductive vacuum plasma spraying, the coating applied by moving a plasma beam of the inductive plasma spray and the base element with respect to each other in such a manner that a central point of impact of the plasma beam on the anode surface and a center line of an active focal track concentric to an axis of anode rotation at last roughly coincide, whereby the edge of the plasma beam is mostly in a region outside the recess.

2. The method according to claim 1, further comprising applying the coating by repeated overcoating of individual spray coatings.

3. The method according to claim 1, wherein the coating comprises a thickness between 0.4–0.6 mm.

4. The method according to claim 1, wherein applying the coating further comprises inductive power between 50–100 kW.

5. The method according to claim 1, wherein applying the coating further comprises delivering a coating spray powder between 10–50 grams/min.

6. The method according to claim 1, wherein preparing the base element further includes preheating the base element before applying the coating.

7. The method according to claim 6, wherein the preheating further comprises preheating the base element to a temperature below 1,500° C.

8. The method according to claim 1, further comprising a local deposition temperature in a region of the coating being between 1,400–2,400° C.

9. The method according to claim 1, further comprising annealing the anode after coating.

10. The method according to claim 1, wherein the coating is primarily applied within the recess and further comprising grinding the coating to a plane of the adjoining anode base element to provide a clean lateral delimitation of the coating to the base element.

11. The method according to claim 1, wherein a particle stream from the plasma beam is adjusted so that the particle stream of the plasma beam arriving within the active focal track primarily encompasses a region located within a half-value width of a Gaussian particle distribution of the plasma beam.

12. The method according to claim 1, further comprising grinding the coating.

13. A method for the production of an anode for X-ray tubes comprising:

preparing a base element of the anode by creating a ring-shaped recess in the base element, the recess having a depth approximately equal to the desired finished thickness of a coating that emits X-ray radiation and a width approximately equal to the desired finished width of the coating; and applying the coating by inductive vacuum plasma spraying, wherein an edge of a plasma beam of the inductive vacuum plasma spray is mostly in a region outside the recess.

* * * * *